US006474903B1

(12) United States Patent
Marts et al.

(10) Patent No.: US 6,474,903 B1
(45) Date of Patent: Nov. 5, 2002

(54) RETRACTABLE BARRIER STRIP

(75) Inventors: Donna J. Marts; Stacey G. Barker, both of Idaho Falls, ID (US); Andrew Wowczuk; Thomas E. Vellenoweth, both of Wheeling, WV (US)

(73) Assignee: Bechtel BWXT Idaho, LLC., Idaho Falls, ID (US)

( * ) Notice: Subject to any disclaimer, the term of this patent is extended or adjusted under 35 U.S.C. 154(b) by 0 days.

(21) Appl. No.: 09/409,176

(22) Filed: Sep. 30, 1999

(51) Int. Cl.[7] ..... E01F 13/12
(52) U.S. Cl. ..... 404/6
(58) Field of Search ..... 404/6; 256/1, 13.1; 403/54, 57, 150, 157

(56) References Cited

U.S. PATENT DOCUMENTS

| | | | | | |
|---|---|---|---|---|---|
| 629,185 | A | * | 7/1899 | Arnold | 403/157 |
| 3,456,920 | A | * | 7/1969 | Elvington | 256/1 |
| 3,650,123 | A | * | 3/1972 | Sheppard, Jr. | 464/133 |
| 4,097,170 | A | * | 6/1978 | Dickinson | 404/6 |
| 5,322,385 | A | * | 6/1994 | Reisman | 404/6 |
| 5,498,102 | A | * | 3/1996 | Bissell | 404/6 |
| 5,507,588 | A | * | 4/1996 | Marts et al. | 404/6 |
| 5,588,774 | A | * | 12/1996 | Behan | 404/6 |
| 5,820,293 | A | * | 10/1998 | Groen et al. | 404/6 |
| 5,890,832 | A | * | 4/1999 | Soleau | 404/6 |
| 5,911,542 | A | * | 6/1999 | Obrock et al. | 405/219 |

FOREIGN PATENT DOCUMENTS

| | | | | |
|---|---|---|---|---|
| FR | 2 605 655 | * | 4/1988 | 404/6 |
| FR | 2 714 404 | * | 6/1995 | 404/6 |
| JP | 11-140835 | * | 5/1999 | 404/6 |

* cited by examiner

*Primary Examiner*—Gary S. Hartmann
(74) *Attorney, Agent, or Firm*—Alan D. Kirsch

(57) ABSTRACT

A portable barrier strip having retractable tire-puncture spikes for puncturing a vehicle tire. The tire-puncture spikes have an armed position for puncturing a tire and a retracted position for not puncturing a tire. The strip comprises a plurality of barrier blocks having the tire-puncture spikes removably disposed in a shaft that is rotatably disposed in each barrier block. The plurality of barrier blocks hare hingedly interconnected by complementary hinges integrally formed into the side of each barrier block which allow the strip to be rolled for easy storage and retrieval, but which prevent irregular or back bending of the strip. The shafts of adjacent barrier blocks are pivotally interconnected via a double hinged universal joint to accommodate irregularities in a roadway surface and to transmit torsional motion of the shaft from block to block. A single flexshaft cable is connected to the shaft of an end block to allow a user to selectively cause the shafts of a plurality of adjacently connected barrier blocks to rotate the tire-puncture spikes to the armed position for puncturing a vehicle tire, and to the retracted position for not puncturing the tire. The flexshaft is provided with a resiliently biased retracting mechanism, and a release latch for allowing the spikes to be quickly retracted after the intended vehicle tire is punctured.

29 Claims, 4 Drawing Sheets

RETRACTABLE BARRIER STRIP

CONTRACTUAL ORIGIN OF THE INVENTION

The United States Government has rights in this invention pursuant to Contract No. DE-AC07-94ID13223 between the United States Department of Energy and Lockheed Martin Idaho Technologies Company.

BACKGROUND OF THE INVENTION

1. Field of the Invention

This invention relates to an apparatus for puncturing a vehicle tire. More particularly, the present invention relates to an improved portable and retractable barrier strip for puncturing a fleeing vehicle's tires.

2. State of the Art

The need to effectively and safely stop a fleeing vehicle without damage to non-offending vehicles or harm to people involved has long been a concern for law enforcement officials. Consequently portable spike barrier strips have been developed for deployment across the anticipated path of a fleeing vehicle to puncture the vehicle's tires and more quickly end potentially dangerous car chases. Examples of prior art spike barrier strips are disclosed in U.S. Pat. Nos. 4,382,714 and 4,995,756.

Unfortunately, these known barrier strips have several drawbacks. For example, in order to stop a fleeing vehicle and yet avoid collateral damage to non-offending vehicles that may be using the same path, these prior-art barrier strips must be deployed in the path of the vehicle either (1) when the area is tightly controlled or (2) only immediately prior to the fleeing vehicle passing. Otherwise, damage to any non-offending vehicles traveling the same path is almost always certain because the sharp, tire-puncture spikes remain exposed at all times during deployment of the barrier.

To solve these and other problems, retractable barrier strips have been developed, such as disclosed in U.S. Pat. No. 5,507,588 to Marts, et al, which disclosure is included herein by reference. The '588 barrier strip comprises a plurality of barrier blocks interconnected in a linear fashion, each barrier block having retractable spikes disposed therein, and designed to remain relatively stable and motionless while a vehicle tire rolls thereover. In its preferred embodiment, a shaft is rotatably disposed in each barrier block, the shaft removably, pivotally, and rotatably interconnecting each barrier block to the next adjacent barrier block to form the barrier strip. With the pivotal connection of adjacent barrier blocks, the barrier strip may be rolled up for easy retrieval, portability, and storage purposes, and simply unrolled to an extended position for deployment and use.

The spikes, preferably hollow, are removably disposed in the shaft, and the shaft may be rotated to arm the spikes for puncturing a vehicle tire, and counterrotated to retract the spikes into a hollow bed for not puncturing a tire. When the spikes are retracted, a vehicle tire may roll over the barrier block without damage. A rotating mechanism is provided to allow a user to rotate the interconnected shafts of all barrier blocks, to thereby simultaneously extend or retract all spikes of all blocks in the barrier strip.

The retractable spikes allow for deployment personnel to easily and safely deploy the strip at a convenient time, with the spikes in a retracted position. The spikes remain in the retracted position, allowing non-offending and law enforcement vehicles to drive over the stable and non-moving barrier blocks without damage, until a fleeing vehicle nears.

At that point, the spikes may be safely activated by a law enforcement officer to an armed position from a remote location for maximum safety. Following puncture of the tires of the target vehicle, the spikes may then be retracted to allow other vehicles to again follow the same path without damage.

While this retractable barrier strip has solved many of the problems of the prior art, there are some concerns which it does not currently address. For example, the pivotal connection of the shafts of adjacent barrier blocks in the '588 device does not adequately allow for irregular road surfaces and curves in all cases. This configuration also tends to subject the shafts to relatively high stresses when in use, which reduces the durability and reliability of the device. For example, when a vehicle strikes the barrier strip, it imparts a lateral deflecting force which tends to twist adjacent barrier blocks about their pivotal connection in a horizontal plane. This horizontal twist subjects the pivotal connection of the shafts to very high stresses, and leads to premature failure of the connection. It would therefore be desirable to have a retractable barrier strip which incorporates a more robust pivotal connection between blocks while still allowing easy rotation and pivoting of connected shafts. It would also be desirable to have a retractable barrier strip which more adequately resists stress at the connection point between the shaft of adjacent barrier blocks, while still allowing for irregularities in roadway surfaces and road curvature.

Additionally, in the prior art retractable barrier strip, the hinge connection of adjacent barrier blocks allows the barrier strip to be bent or rolled up backwards, with the top of the barrier blocks facing out, rather than in. This situation presents the possibility of the spikes extending out from the rolled up unit, potentially causing property damage or injury to users. It would therefore be desirable to have a retractable barrier strip in which the pivotal connection of adjacent blocks prevents significant back bending of adjacent blocks, thus allowing the barrier strip to be rolled up in only one orientation with the tops of the blocks facing inwardly.

The barrier strip of the '588 patent also utilizes a two-cable push-pull system for rotating the shaft to extend or retract the spikes. This system is complicated and cumbersome, and presents reliability and maintenance problems. Because the linearly moving cables extend the entire length of the barrier strip, they encounter frictional resistance along their entire length. Consequently, the force required to pull the cable and rotate the shafts is considerable, and this force increases as the length of the barrier strip increases. Additionally, with the prior push-pull cable system, arming or disarming the spikes requires a specific movement on the part of the operator. It would therefore be desirable to have a retractable barrier strip with a simpler, more reliable spike extension and retraction mechanism for remote arming of the spikes, and one which automatically retracts the spikes when released, rather than requiring a separate motion to retract them.

Moisture and debris buildup in the spike hollow bed of the '588 invention is also an occasional problem. With wind, rain, and vehicle motion, dirt, sand, and other debris is easily swept into the hollow-bed for surrounding the spikes. While water quickly runs out or evaporates from the hollow-bed, the sand, dirt, etc. tends to stay, causing excess wear to the device and possibly interfering with its proper operation. It would therefore be desirable to have a retractable barrier strip with means for drainage around the spikes, and means for keeping the rotational area free from mud, dirt, and debris.

OBJECTS AND SUMMARY OF THE INVENTION

It is therefore an object of the present invention to provide a retractable barrier strip having a universal-joint connection between shafts of adjacent barrier blocks to reduce stress at the connection point, and to more fully allow for irregularities in roadway surfaces and road curvature.

It is another object of this invention to provide a retractable barrier strip having adjacent barrier blocks hingedly connected to each other for a stronger connection that also substantially disallows back bending.

It is another object of this invention to provide a retractable barrier strip having a simple, single cable system for rotating the shaft to extend the spikes.

It is another object of this invention to provide a retractable barrier strip having a simple, single cable spike extension system, which automatically retracts the spikes when released, rather than requiring a separate motion to retract them.

It is another object of this invention to provide a retractable barrier strip having a remotely controlled, power activated spike extension system, which allows the user to extend or retract the spikes from a greater distance away from the barrier strip.

It is yet another object of this invention to provide a retractable barrier strip having means for drainage around the spikes, and for keeping the rotational area free from mud, dirt, and debris.

It is still another object of this invention to provide a method of deploying a portable barrier strip across the path of a target vehicle to puncture at least one of the vehicle's tires.

The above and other objects are realized in a portable barrier strip having retractable spikes disposed in a plurality of interconnected tire mountable barrier blocks. The spikes are disposed in a rotatable shaft disposed within each barrier block, and the shafts of adjacent barrier blocks are advantageously interconnected by a universal-joint to reduce stress at the connection point, and to more fully allow for irregularities in roadway surfaces and road curvature. The spikes are extendable by rotating the connected shafts of the plurality of barrier blocks by means of a single flexible cable or "flexshaft " housed in a flexible, cylindrical tube. The flexshaft is spring-loaded and incorporates a ratchet mechanism with a release lever such that it may be rotated to arm or extend the spikes, and by moving the release lever, will automatically retract the spikes under the spring force, rather than requiring a separate motion to retract them. Alternatively, the flexshaft may be rotated by an electrical motor or other power means, which may be controlled by direct wire or through a wireless remote.

The barrier blocks are hingedly connected to each other, rather merely having the rotatable shafts of adjacent blocks pivotally connected, which provides a more robust connection, and also limits the amount of back bending, thus providing added protection for the rotatable shaft pins and increased overall pad stability. In the preferred embodiment, each block has a first end and a second end. The first end comprises a pair of widely spaced hinge loops, and the second end comprises a pair of more closely spaced hinge loops. The hinge loops of the first end of one block mate with the hinge loops of the second end of an adjacent block, and are interconnected by a hinge pin which allows rotation of connected blocks relative to each other about a horizontal axis that is generally perpendicular to the axis of the spike shaft.

The hinge loops are also configured with an end face which interferes with backward rotation of adjacent blocks so as to freely allow pivoting of adjacent barrier blocks in a manner which draws top surfaces of adjacent blocks together, but substantially prevents pivoting of the hinge means which draws the bottom surfaces of adjacent blocks together. This feature ensures that the barrier strip can only be rolled up with the top surfaces of blocks facing inward.

In the preferred embodiment, the hollow bed for receiving the retracted spike is also provided with means for drainage around the spikes, and means for keeping the rotational area free from mud, dirt, and debris. Other objects and features of the present invention will be apparent to those skilled in the art, based on the following description, taken in combination with the accompanying drawings.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
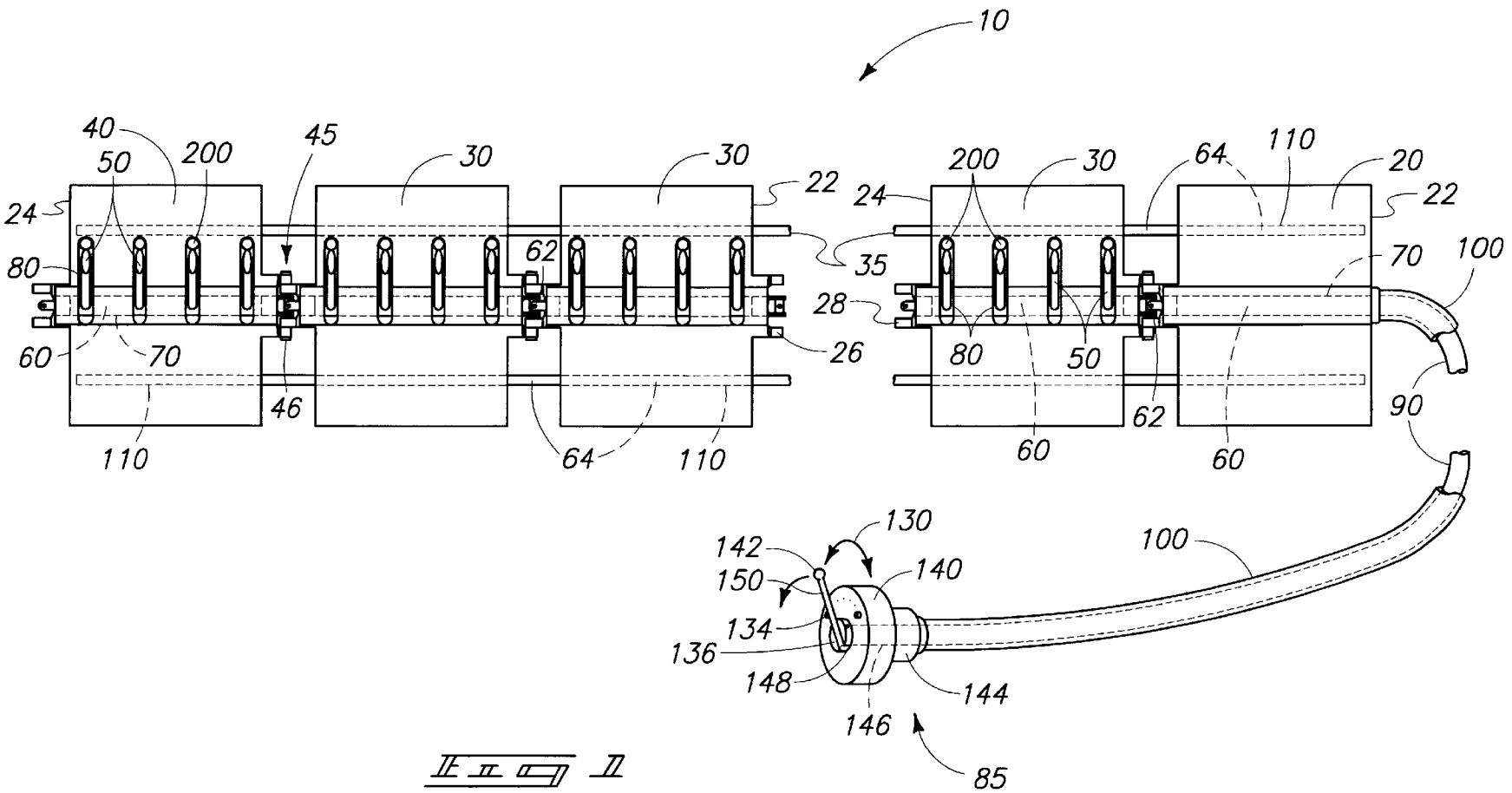
FIG. 1 provides a plan view of the present invention barrier strip in its deployed position.
Figure 5B:
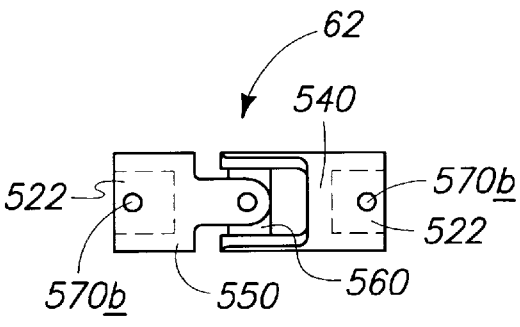
FIGS. 5A–B, respectively, depict side views of the rotatable shaft and u-joint for interconnecting the shafts of adjacent barrier blocks in a barrier strip.

FIG. 1 depicts a plan view of the present invention barrier-strip 10 comprising a plurality of barrier blocks 30 connected in a linear fashion, and extending between a first end barrier block 20 and second end barrier block 40. Barrier blocks 30 and 40 comprise a plurality of spikes 50 removably disposed in a rotatable shaft 60, and normally housed in a hollow-bed portion 80. The shaft 60 is rotatably disposed within a first bore 70 of each block 30, and the shafts of adjacent blocks are connected by universal joint 62, described more fully below (FIG. 5B). The universal joint 62 is preferably removable so that adjacent blocks may be disconnected when desired. The first end barrier block 20 preferably does not include spikes, but serves primarily as an attachment mechanism for the activation cable 90, described in more detail below. However, the first end barrier block 20 may be provided with spikes in a manner similar to the other barrier blocks 30 and 40. The second end barrier block 40 differs from barrier blocks 30 only in that it forms the end of the strip 10 and flexible cords 64 terminate therein, as described below.

Break lines 35 indicate a plurality of barrier blocks 30, not shown, sufficient to form the barrier strip long enough to extend across the path of a fleeing vehicle. It will be apparent that the barrier strip 10 could be formed of any number of barrier blocks to form a strip of any desired length. In use, barrier strip 10 is deployed by unrolling it across a traveled way, with spikes 50 originally maintained in a retracted position, i.e., in a substantially horizontal plane within hollow-bed portion 80, for not puncturing a vehicle tire.

Each of the barrier blocks 20, 30, and 40 are adjacently interconnected by hinges 45. In the preferred embodiment of the present invention, each barrier block 20, 30, or 40 has a first end 22 and a second end 24. With the exception of the first barrier block 20, the first end 22 of each block comprises a pair of widely spaced hinge loops 26, and, the second end comprises a pair of more closely spaced hinge loops 28. The hinge loops of the first end 22 of one block mate with the hinge loops of the second end 24 of an adjacent block, and are interconnected by a pair of hinge pins 46, which allows rotation of connected blocks relative to each other about a horizontal axis that is generally perpendicular to the axis of the shaft 60. The hinge pins 46 are preferably removable to allow disconnection of adjacent barrier blocks.

Figure 4:
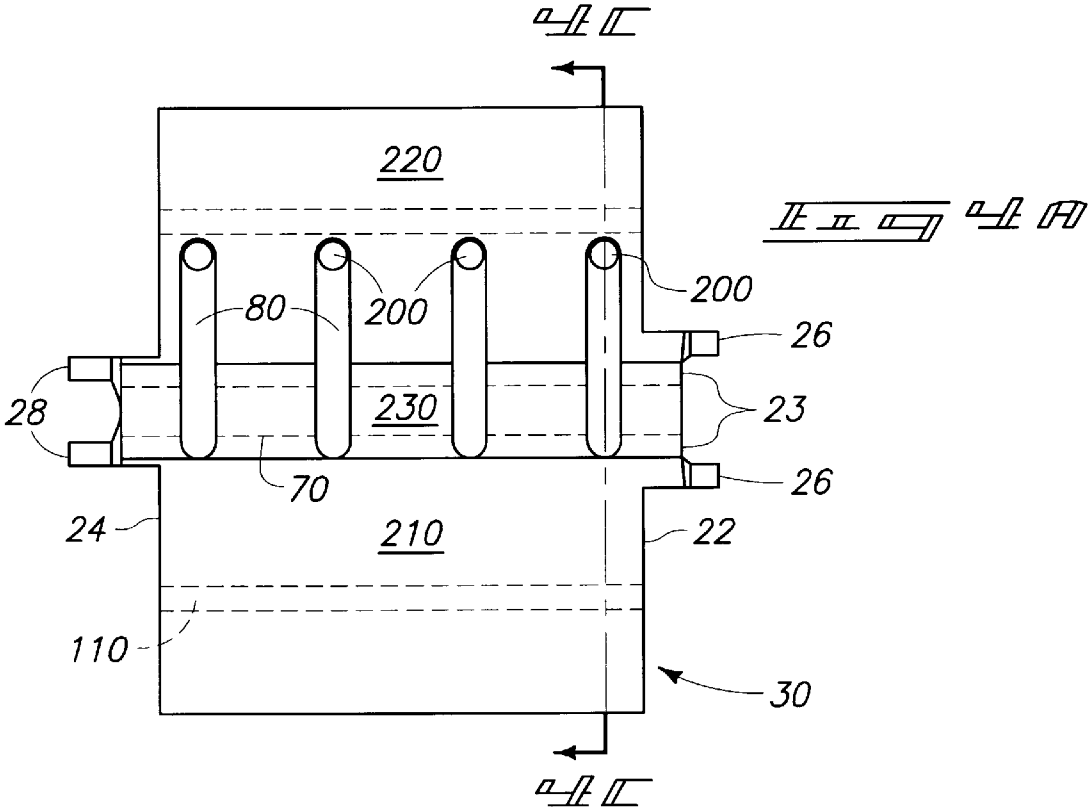
FIGS. 4A–C, respectively, depict plan, side cross-sectional, and end views of a barrier block according to the present invention.
Figure 2:
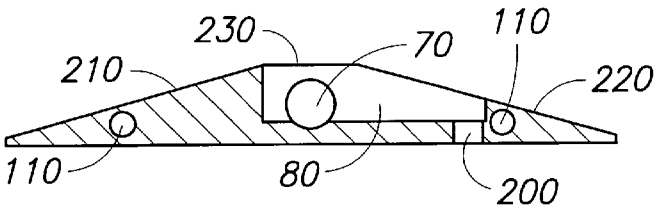
Figure 3:
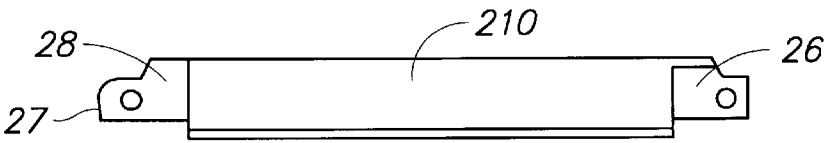

The closely spaced hinge loops 28 also comprise substantially vertical end faces 27 (FIG. 4B) which are configured to be disposed near the end surface 23 (FIG. 4A) between the widely spaced hinge loops 26 of the adjacent barrier block when the hinges are connected. The substantially vertical surface 27 is advantageously sharp edged at the bottom, and has a rounded edge at the top. This configuration causes the bottom of the end face 27 to contact the end surface 23 between the widely spaced hinge loops 26 when the hinge is rotated one direction, so as to interfere with pivoting of the hinge connection which would draw the bottom surfaces of adjacent blocks together. However, the curved top edge of end face 27 freely allows pivoting in the other direction which tends to bring the top surfaces of adjacent blocks together. This anti-back bending feature allows for position control during unit storage, and provides added protection for the rotatable shaft pins and increased overall pad stability. As depicted in FIG. 4B, however, the end face 27 may have a slight angle, thus allowing a controlled amount of back bending. This configuration is desirable for accommodating an irregular roadway surface, such as a rutted roadway or a roadway crown wherein the surface is slightly humped when viewed in cross section.

Adjacent barrier blocks 20, 30, and 40 are also connected by u-joints 62 and flexible cords 64. The u-joints 62 hingedly and removably interconnect the shaft 60 of adjacent barrier blocks so as to accommodate flexing of the barrier strip at the hinges 45, as well as to accommodate for uneven pavement or curved roads. It will be apparent that the double-hinged nature of the universal joint 62 will allow more flexure between adjacent shafts 60 than the prior art single hinged arrangement. The flexible cords 64 run through second bore 110 in adjacent barrier blocks 20, 30, and 40, and terminate in the first end barrier block 20 and the second end barrier block 40. The flexible cords 64 are preferably formed from a tightly coiled spring-type wire for optimum flexibility, but may also comprise flexible cables or comparable flexible cords. These cords are attached to each barrier block 30 through which they pass, including the first and second end blocks 20 and 40, preferably by a chemical adhesive, or through a mechanical connection.

By virtue of their location on opposite sides of the shaft 60 and at the extreme ends of the barrier blocks, these cords 64 provide additional strength to resist horizontal twisting of adjacent barrier blocks, thus reducing stress on the u-joint 62 and hinges 45, and preventing the barrier strip from moving excessively on the roadway surface when deployed. The cords 64 also contribute to the overall stability of the barrier strip 10 by keeping adjacent barrier blocks properly aligned. When the connected shafts of a line of barrier blocks are rotated, frictional resistance within the first bore could make adjacent blocks tend to rotate slightly with respect to each other, causing one edge of the barrier block to rise off of the roadway surface. By virtue of their widely spaced location, the cords 64 resist this torsional effect, preventing the barrier strip from twisting and rising off of the roadway surface when deployed.

As shown in FIG. 1, the control means 85 preferably comprises a manual activation means 140, connected to activation cable 90 which is housed in flexible cable tubing 100. Cable 90 runs from the activation means 140 to the first end 22 of the first block 20, where it is connected to shaft 60 within the first block. Activation of cable 90 by the activation means 140 causes a torsional force to be exerted on cable 90, which is transmitted to the end of shaft 60 in the first block 20. This rotational force is transmitted down the line of connected shafts 60 through u-joints 62, causing shaft 60 of each barrier block to be rotated to an armed position wherein spikes 50 extend upward for puncturing a tire.

Control means 85 can be any means capable of exerting a torsional force on cable 90 to extend the spikes to the armed position, including but not limited to, mechanical, electrical, manual, or some combination or other means well-known in the art. For example, the control means could comprise a pneumatic actuator, a solenoid actuator, an electrical motor, or other comparable means of providing a rotational force. In the preferred embodiment, the manual activation means 140 comprises a handle 142 for twisting by a user from a first, unarmed position to a second, armed position as indicated by arrow 130, a torsional spring 144 for exerting a biasing force against the rotation of cable 90, and a ratchet mechanism 146 for engaging handle 142 with cable 90. The ratchet mechanism is preferably an overrunning ratchet and pawl or similar mechanism, which allows free rotation of handle 142 in the disarming direction, but engages the handle with cable 90 when rotated in the arming direction. Ratchet 146 also includes release 148 incorporated into the hub 136 of activation means 140 for disengaging the handle 142, to release the torsion on cable 90. It will be apparent that rather than flexible cable 90, the barrier strip could be provided with a rigid shaft for connecting to the shaft of the first barrier block 20 to activate the spikes. However, a flexible actuating means is preferred for the reasons given above.

The spikes are normally biased in the retracted position by spring 144 for safety. To extend the spikes, after unrolling the strip across a roadway, a user rotates handle 142 against the biasing force of spring 144 toward the second, armed position to twist cable 90 about its long axis and rotate shaft 60 to extend spikes 50 to the armed position. It will be apparent that the user must maintain rotational force on handle 142 to keep the spikes in the armed position due to the constant biasing force of spring 144.

The spikes may then be retracted in one of two ways. First, and preferably, because it is hingedly connected to the hub 136 of the activation means 140, the end of handle 142 may be pulled forwardly in the direction of arrow 132 to trigger release 148. When the release is triggered, the ratchet mechanism 146 becomes mechanically disengaged from the handle 142, allowing spring 144 to automatically and rapidly counterrotate cable 90 and retract the spikes. The ratchet mechanism 146 then allows the handle to be freely rotated back to the first position to re-engage with the cable. Alternatively, the spikes may be retracted by simply releasing handle 142 and allowing the spring force on cable 90 to retract the spikes, rotating the handle back to the original position. This second method does not retract the spikes as quickly as the preferred method, but is still effective.

Figure 3:
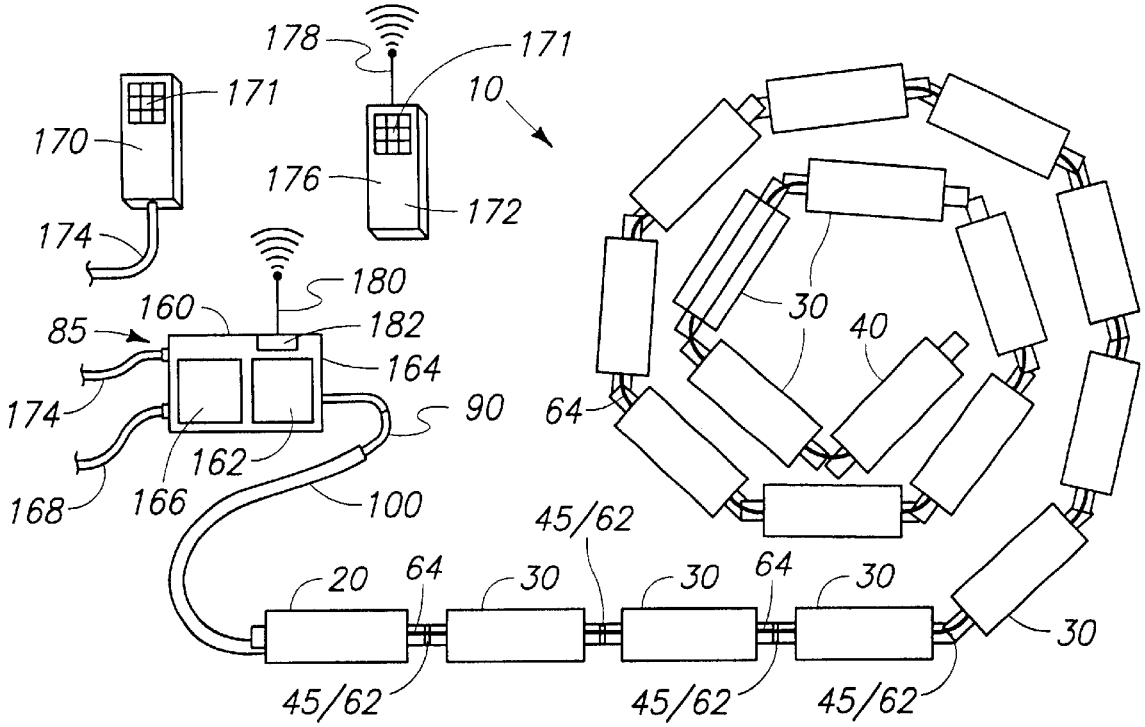
FIG. 3 is an end-elevation view of one embodiment of the barrier strip in a semi-rolled-up position for retrieval, portability, and storage purposes.

The control means 85 may alternatively comprise a power activation means 160 as depicted in FIG. 3. In this embodiment, activation means 160 comprises an electric motor 162 disposed in a housing 164 which is connected to cable 90. The electric motor 162 may be powered by a battery 166 disposed within the housing 164, or alternatively, may be connected to an external power source via electrical cable 168, such as from a motor vehicle (not shown) or other available power source. The power activation means will also preferably incorporate a torsional biasing means and quick release mechanism as described above, or other comparable system, for allowing the spikes to be rapidly retracted at will, and for ensuring that spikes are safely retracted during storage and handling of the barrier strip.

Power activation means 160 may be activated from a remote location either by a hard-wired activation unit 170, or by a wireless remote activation unit 172. Either unit, 170 or 172 will typically include a keypad 171 or other comparable means well known in the art for activating the motor 162 to deploy or retract the spikes. Such a keypad will typically include at lease an activation button or switch for extending the spikes, a similar button or switch to retract them, and indicator means to verify operational parameters, such as whether the spikes are extended or retracted, whether the unit has power, whether the activation means is receiving the remote signal, etc.

The hard-wired activation unit 170 may be connected to the activation means 160 via an electrical cable 174, which may connect through electrical cable 168, or may separately connect to activation means 160 as shown. The wireless remote activation unit 172 comprises a transmitter 176 and antenna 178 for transmitting a signal to a corresponding antenna 180 and receiver 182 which are incorporated into the power activation means.

By use of the hard-wired activation unit and power activation means 160, a user of the device may stand as far away from the actual site of deployment as the electrical cables will allow. However, with the wireless remote activation unit and using battery power, a user of the barrier strip may stand as far away from the unit as the transmitter will allow. This allows law enforcement officers to deploy the spike strip, and then activate it from a remote location with no officers or police cruisers in sight of the actual deployment location. With no vehicles or personnel near the deployment site, target vehicles are far less likely to detect and avoid running over the spike strip.

The control means 85 as described provides several improvements over the prior art. First, in either the manual or power activated embodiments, the device provides quicker response and requires less force to activate than the dual cable push-pull system disclosed by the 588 patent. With the dual cable configuration, the longitudinally moving activation cables encounter friction all along their length, which is at least twice the length of the barrier strip. This friction can be substantial for a long barrier strip, and creates greater forces which must be overcome. This makes the unit somewhat difficult to operate in the manual embodiment, and requires more motor power in the power activated embodiment.

With the present invention, in contrast, there is less length of cable, and that cable only rotates, rather than moving linearly. Consequently, there is substantially less surface area of cable producing frictional resistance, allowing the device to move more freely. Second, because activation means 140 or 160 includes a biasing means and quick-release mechanism, the spikes may be more quicky retracted when desired. This allows a user to retract the spikes very quickly following puncture of an offending vehicle's tires, and reduces the possibility of damage to non-offending vehicles. The device also allows non-offending vehicles to pass without damage to their tires before the spikes are extended for puncturing an offending vehicle's tires.

Finally, as with the prior art, the control means 85 can be placed away from the immediate location of deployed barrier strip 10, limited only by the selectable length of cable 90 and tubing 100 in the embodiment of FIG. 1, or by the power of the transmitter or electrical cable in the embodiments of FIG. 3. As a practical matter, the length of cable 90 is limited by friction within the tubing 100 and by torsional strain within the cable 90 which reduces the amount of rotation at the first barrier block relative to the actual amount of rotation imparted by the user. Nevertheless, by having control means 85 remote from barrier strip 10, deployment personnel remain safe from any non-offending or fleeing vehicle activity near the strip.

Since barrier strip 10 is easily portable, it may be deployed as shown at any time in advance of a fleeing vehicle. Because of the retractable spikes, there is minimal concern for inadvertent damage to non-offending vehicles. Moreover, the barrier strip 10 is inherently stable because of the hinge connections 45 and flexible cords 64, and is also highly adaptable to uneven or curved roadway surfaces because of u-joints 62. The u-joints reduce stress in the shafts 60 of adjacent barrier blocks caused by uneven roadway surfaces, and the cords 64 add to the strength of the connection between adjacent blocks, thus increasing the durability and stability of the barrier strip.

By virtue of this design, deployment personnel can avoid potentially dangerous conditions because the spikes remain in the retracted position during deployment, and remain retracted until armed on demand, and the user can activate the unit from a position well away from the roadway. Moreover, because of the automatic retraction feature, the strip can be deployed at any time prior to the fleeing vehicle passing, and need not be limited to some moment immediately prior to the fleeing vehicle passing. Then, when the fleeing vehicle passes, the user may immediately retract the spikes. Thus, damage to any non-offending vehicles that may be traveling the same path before or after the offending vehicle is prevented.

It will be apparent that barrier strip 10 may be removably or permanently secured to the surface on which it is placed. For example, the strip may be attached to a road surface in a substantially permanent fashion by use of adhesive materials or other means known in the art. Alternatively, the strip may be secured in a sunken trench across a road, such that the strip is below the surface of the road in the trench, and only the spikes protrude above the surface when in the armed position for puncturing a tire.

Figure 2:
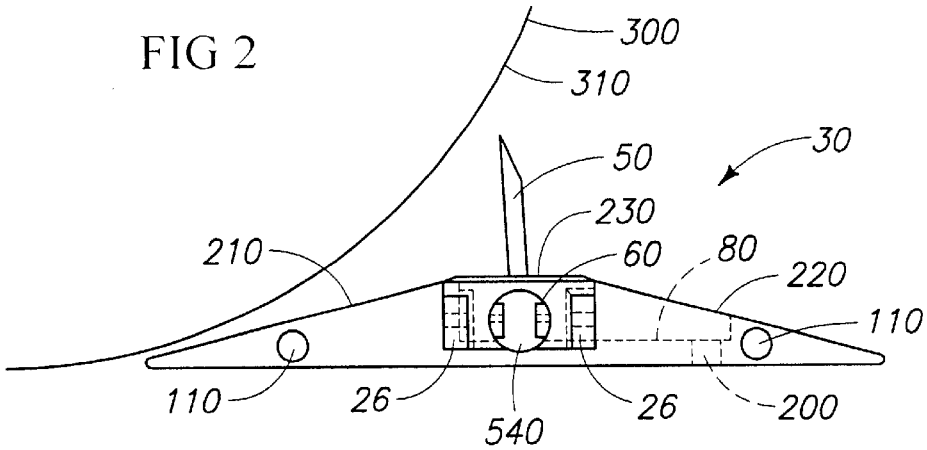
FIG. 2 is a side-elevation view of barrier block having the spikes in an armed position for puncturing a vehicle tire.

FIG. 2 depicts a side-elevation view of barrier block 30 having shaft 60 rotatably disposed in the first bore, and spikes 50 removably disposed in the shaft. FIG. 2 depicts the spikes 50 in the armed position, extending substantially vertically upwardly. When armed, the spikes 50 may be placed in a slightly angled position as shown, or may be oriented vertically. For relatively fast moving vehicles, the inventors have found that the device is most effective when the spikes are essentially vertical.

When tire 300 encounters the block 30, it is first received by leading-edge surface 210. As the tire rolls over the block and onto top edge surface 230, spike 50 punctures the tire at a substantially perpendicular angle relative to the tire 300 at some point of insertion 310. Although not explicitly depicted, as tire 300 continues to roll over barrier block 30, shaft 60 rotates substantially in synchronization with the tire as the tire rolls over the top edge surface 230 and onto trailing edge surface 220 after being punctured by the spike 50. In so doing, the spike 50 is removed from the shaft 60 by the tire at a likewise substantially perpendicular angle relative to the tire, thereby leaving the barrier strip stable and substantially motionless as the tire rolls thereon and over and thereby avoiding excessive tearing of the tire by the spike.

Advantageously, the leading edge 210 and trailing edge 220 are identical in length and slope, such that the barrier strip may be used with vehicles moving in either direction either the same as or opposite the direction shown in FIG. 2. This feature allows the barrier strip of the present invention to be deployed from either side of a roadway relative to the direction of traffic, with no reduction in its effectiveness.

FIG. 3 is an end-elevation view of barrier strip 10 in a semi-rolled-up position. Shown schematically are the connecting means, comprising hinges 45 and universal joints 62, and flexible wires 64, which all pivotally interconnect each of the barrier blocks, 20, 30, and 40. As such, barrier strip 10 can be rolled up for retrieval, portability, and storage purposes, and simply unrolled and extended for deployment purposes (FIG. 1). When strip 10 is rolled up, spikes 50 are always biased in the retracted position for each barrier block.

For additional storage and handling safety and convenience, in the embodiment of FIG. 1 the activation handle 142 is preferably provided with a catch 150 that is configured to hook onto a limiting peg 134 when disposed at its first or unarmed position. The catch and peg are configured to hold the handle rotated outwardly as shown by arrow 132 such that the release 148 is always triggered during storage and handling. This condition prevents any torsional force from being applied to the cable 90, thus allowing the torsional spring 144 to naturally hold the spikes in the retracted position. This configuration protects the spikes from damage during storage and handling, and also protects users from injury from the sharp spikes. It will be appreciated that similar features may be incorporated into the power activated embodiment depicted in FIG. 3 and described above.

FIGS. 4A–C depict, respectively, plan, front end, and right side cross-sectional views of barrier block 30 (from FIG. 1), excluding the spikes 50, shaft 60, and u-joint 62. As depicted in FIGS. 4A–C, barrier block 30 is also representative of second-end barrier block 40. Barrier block 30 comprises an inclined leading-edge surface 210 for receiving a vehicle tire, an inclined trailing-edge surface 220 for securing the block in place by the tire after piercing of the tire by the spikes, and a top-edge surface 230 communicating between the leading and trailing-edge surfaces. As noted above, the leading and trailing edge surfaces have essentially the same length and configuration, making this device functional for vehicles traveling in either direction.

First bore 70 is located substantially below top-edge surface 230 and communicates between the surface of the first end 22 and second end 24. Second bores are located substantially below leading-edge surface 210 and trailing-edge surface 220, and also communicate between the surface of the first end 22 and second end 24. Hollow-bed portion 80 is located substantially within top-edge and trailing-edge surfaces 230 and 220, and receives spikes 50 (FIG. 1) in the retracted position.

As depicted in FIGS. 4A and 4C, the barrier block 30 of the present invention is advantageously provided with drain holes 200 located at the extreme end of each hollow-bed 80. The drain holes 200 allow for drainage of moisture around the spikes, and also keep the rotational area free from mud, dirt, and debris. It will be appreciated that this configuration improves the operation and durability of the barrier strip.

Figure 5A:
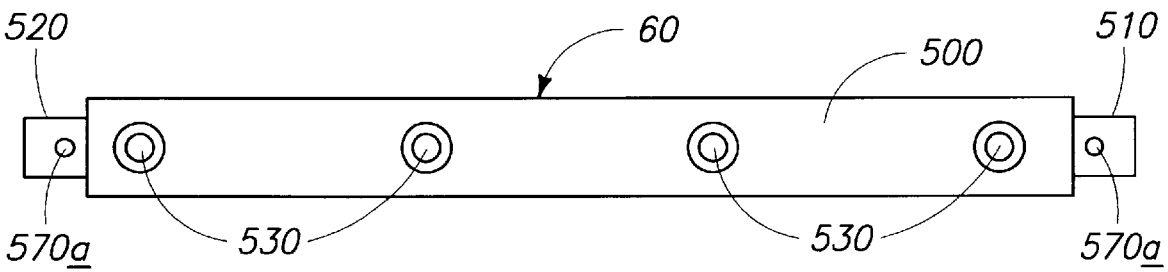

FIGS. 5A–B, respectively, depict side views of the rotatable shaft 60 and u-joint 62 for interconnecting the shafts of each of the barrier blocks in a barrier strip 10. Referring to FIG. 5A, shaft 60 comprises shaft body 500 and first and second end extensions 510 and 520, respectively. Shaft 60 is configured to be rotatably disposed within first bore 70 (FIG. 1) of each barrier block, and ends 510 and 520 extend outward therefrom. Circular holes 530 removably receive spikes 50 (not shown), and are formed with an internal shoulder for receiving a grommet for removably holding spike 50 in place.

As shown in FIG. 5A, first end 510 has hole 570*a*, and second end 520 has hole 570*b* formed therethrough. The holes 570 a and b are configured to accommodate connection of the ends of the shaft 60 to one or the other end of universal joint 62. Referring to FIG. 5B, the universal joint 62 generally comprises a first u-bracket 540 and a second u-bracket 550, which are hingedly connected at right angles to each other by a hinge post 560 centrally disposed therebetween. Each u-bracket comprises a cylindrical opening 522 which is configured to accept either the first end extension 510 or second end extension 520 of a shaft 60. Holes 570*b* are provided to align with the holes 570*a* in the shaft ends and allow insertion of a locking pin or other means to securely attach the u-joint to the end of the shaft. The u-joint 62 is configured to be easily disconnected so that adjacent barrier blocks may be disconnected at will.

By virtue of the double-hinged configuration of u-joint 62, shafts 60 of adjacent barrier blocks will properly rotate, even if the connected barrier blocks are slightly misaligned vertically or horizontally. This feature helps accommodate uneven pavement or other surfaces, without compromising the function of the device. Moreover, because the barrier blocks are pivotally interconnected, barrier strip 10 can be easily rolled up for retrieval, portability, and storage purposes (see FIG. 3) with spikes 50 in the retracted position.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

We claim:

1. A portable tire-puncture apparatus for puncturing a vehicle tire, comprising:

portable barrier-strip for communicating with a vehicle tire, said barrier-strip means comprising a plurality of generally linearly disposed adjacent barrier blocks, each barrier block having a top surface, a bottom surface, a first side and a second side;

tire-puncture means disposed in the barrier-strip means, having an armed position for puncturing the tire and a retracted position for not puncturing the tire, said tire-puncture means comprising a rotatable shaft disposed in a first bore extending between the first side and the second side of each barrier block, and having at least one spike removably disposed in said rotatable shaft;

control means communicating with the barrier-strip means for arming the tire-puncture means to the armed position and retracting the tire-puncture means to the retracted position;

first hinge means for pivotally interconnecting the tire puncture means of adjacent barrier blocks, said first hinge means comprising a removable universal joint connecting the rotatable shafts of adjacent barrier blocks; and second hinge means integrally formed on the first side and second side of each of the plurality of barrier blocks for pivotally interconnecting adjacent barrier blocks, thereby allowing rotation of connected blocks relative to each other about a horizontal axis.

2. The tire-puncture apparatus according to claim 1 wherein the barrier-strip rests stable in a deployed position for use, in the armed and retracted positions, and remains substantially motionless as the tire rolls thereon and over.

3. The tire-puncture apparatus according to claim 2 wherein the barrier-strip is rolled up for retrieval, portability, and storage purposed and unrolled out in the deployed position for use.

4. The tire-puncture apparatus according to claim 3 wherein the barrier-strip is substantially secured in a location where it is deployed.

5. The tire-puncture apparatus according to claim 2, further comprising a pair of flexible cords disposed within a second and third bore, respectively, formed through each barrier block in the barrier strip, said second and third bores being generally parallel to the first bore, and disposed on opposite sides thereof.

6. The tire-puncture apparatus according to claim 1 wherein the second hinge means are configured to allow pivoting of adjacent barrier blocks about a horizontal axis that is substantially perpendicular to the length of the barrier strip.

7. The tire-puncture apparatus according to claim 6 wherein the second hinge means are configured to freely allow pivoting of adjacent barrier blocks in a manner which draws top surfaces of adjacent blocks together, but substantially prevents pivoting of the hinge means which draws the bottom surfaces of adjacent blocks together.

8. The tire-puncture apparatus according to claim 6 wherein the second hinge means further comprises:

a first pair of widely spaced hinge loops disposed on the first side of each barrier block, said hinge loops being configured for receiving a hinge pin;

a second pair of more closely spaced hinge loops disposed on the second side of each barrier block, the hinge loops on the second side of one block being configured to mate between the widely spaced hinge loops on the first side of an adjacent block, said second hinge loops being configured for receiving a hinge pin; and a first hinge pin for disposing through one of the first hinge loops and one of the second hinge loops to hingedly interconnect them, and a second hinge pin for disposing through the other of the first pair of hinge loops and the other of the second hinge loops to hingedly interconnect them.

9. The tire-puncture apparatus according to claim 8 wherein the first and second hinge loops further comprise a substantially vertical end surface which substantially prevents pivoting of the hinge means in a manner which draws the bottom surfaces of adjacent blocks together.

10. The tire-puncture apparatus according to claim 8 wherein the hinge pins are removable so as to allow adjacent barrier blocks to be selectively disconnected.

11. The tire-puncture apparatus according to claim 1 wherein the control means comprises:

an elongate, flexible, rotatable shaft having a first end and a second end, the second end being connected to the tire puncture means of the barrier strip; and activation means connected to the first end of said shaft for allowing a user to selectively rotate said shaft to arm the tire-puncture means to the armed position and retract the tire-puncture means to the retracted position.

12. The tire-puncture apparatus according to claim 11 wherein said activation means comprises:

spring biasing means for resiliently biasing the tire puncture means in the retracted position, whereby a user must maintain constant force upon the activation means to move and keep the tire puncture means in the armed position; and ratchet means having a release mechanism for automatically allowing the tire puncture means to counterrotate from the armed position to the retracted position under the force of the spring biasing means when the release mechanism is activated by the user.

13. The tire-puncture apparatus according to claim 11 wherein the plurality of barrier blocks further comprise at least a first and second-end block, and wherein the second end of said flexible shaft is connected to the tire puncture means disposed within the first end block.

14. The tire-puncture apparatus according to claim 11 wherein said activation means comprises:

an electric motor connected to the rotatable shaft for rotating said shaft to arm or retract the spikes;

remote control means for controlling the electric motor;

spring biasing means for resiliently biasing the tire puncture means in the retracted position, whereby the electric motor must maintain constant force upon the activation means to move and keep the tire puncture means in the armed position; and a release mechanism actuable by a user for automatically allowing the tire puncture means to counterrotate from the armed position to the retracted position under the force of the spring biasing means when the release mechanism is activated by the user.

15. The apparatus according to claim 14 wherein said remote control means further comprises a controller connected to the electric motor by means of an electrical cable.

16. The apparatus according to claim 14 wherein said remote control means comprises:

a controller including a wireless transmitter for transmitting signals to the electric motor; and a receiver associated with the electric motor for receiving signals from the transmitter.

17. The tire-puncture apparatus according to claim 1 wherein the at least one spike comprises a hollow spike having a base portion removably disposed in the shaft and a cutting tip extending outwardly away from the shaft.

18. The tire-puncture apparatus according to claim 1 wherein each of the plurality of barrier blocks comprises a block of substantially solid material having:

a face for the tire to roll thereon and over, having an inclined leading-edge surface for receiving the tire, an inclined trailing-edge surface for securing the barrier block in place by the tire after piercing of the tire by the tire-puncture means, and a top-edge surface communicating between the leading and trailing-edge surfaces;

a first pair of widely spaced hinge loops disposed on the first side and configured for receiving a hinge pin;

a second pair of more closely spaced hinge loops disposed on the second side and configured to mate between the widely spaced hinge loops on the first side of an adjacent block, said second hinge loops being configured for receiving a hinge pin;

a hollow-bed portion communicating with the face for receiving the tire-puncture means in the retracted position;

a first bore communicating between the first and second side surfaces in a location between the leading- and trailing-edge surfaces substantially below the top-edge surface for receiving the tire puncture means; and second and third bores, respectively, communicating between the first and second side surfaces and generally parallel to the first bore, and disposed on opposite sides thereof, said second and third bores being configured for receiving a continuous flexible cord which interconnects a strip of adjacent barrier blocks.

19. The tire-puncture apparatus according to claim 18 wherein the tire puncture means comprises a rotatable shaft disposed within said first bore, the rotatable shafts of adjacent barrier blocks being pivotally connected, and the rotatable shaft of the first end block being connected to the control means.

20. The tire-puncture apparatus according to claim 19 wherein the pivotal connection of adjacent rotatable shafts comprises a universal joint.

21. The tire-puncture apparatus according to claim 18 wherein said hollow-bed portion further comprises a drain hole extending vertically downward through the bottom of the barrier block for allowing water and debris to drain from the hollow-bed portion.

22. The tire-puncture apparatus according to claim 18 wherein the tire puncture means comprises a rotatable shaft having a shaft body and first and second shaft ends, the shaft body being rotatably disposed within the first bore and the first and second shaft ends extending outwardly therefrom for pivotable interconnection with a corresponding mating shaft end of an adjacent barrier block.

23. The tire-puncture apparatus according to claim 22 wherein the tire-puncture means further comprises at least one hollow spike having a base portion removably disposed in the shaft body and a cutting tip extending outwardly away from the shaft body.

24. The tire-puncture apparatus according to claim 23 wherein the armed position of the tire-puncture means comprises the shaft rotated such that the at least one hollow spike extends substantially vertically upward.

25. The tire-puncture apparatus according to claim 24 wherein the shaft rotates substantially in synchronization with the tire as the tire rolls over the barrier block after being punctured by the at least one hollow spike, thereby leaving the tire-puncture apparatus stable and substantially motionless as the tire rolls thereon and over.

26. The tire-puncture apparatus according to claim 23 wherein the retracted position of the tire-puncture means comprises the shaft rotated such that the at least one hollow spike is received within the hollow-bed portion of the barrier block and whereby the at least one hollow spike does not communicate with the tire as the tire rolls over the barrier block.

27. The tire-puncture apparatus according to claim 26 wherein the control means further comprises:

spring biasing means for resiliently biasing the tire puncture means in the retracted position, whereby a user must maintain constant force upon the activation means to move and keep the tire puncture means in the armed position; and ratchet means having a release mechanism for automatically allowing the tire puncture means to counterrotate from the armed position to the retracted position under the force of the spring biasing means when the release mechanism is activated by the user.

28. A method of puncturing at least one tire of a target vehicle, comprising the steps of:

(a) deploying a barrier strip across an anticipated travel ahead of the target vehicle, the barrier strip comprising a plurality of generally linearly disposed adjacent barrier blocks pivotally interconnected by first hinge means and having tire-puncture means pivotally interconnected by second hinge means comprising a removable universal joint connecting rotatable shafts disposed in a first bore extending between first and second sides of each adjacent barrier block, said tire-puncture means having at least one spike removably disposed in said connected rotatable shaft, said tire-puncture means further having an armed position for puncturing the tire and a retracted position for not puncturing the tire disposed therein and an activation means comprising an elongate, resiliently biased, flexible, rotatable shaft having a first end and a second end, the second end being connected to the tire puncture means of the barrier strip for arming the tire-puncture means to the armed position and retracting the tire-puncture means to the retracted position;

(b) arming the tire puncture means to the armed position by rotating the activation means before the target vehicle arrives at the location of the barrier strip;

(c) maintaining the tire puncture means in the armed position while the target vehicle passes over the barrier strip so as to puncture at least one of the target vehicles's tires.

29. The method of claim 28 further comprising the step of:

(e) maintaining the tire puncture means in the retracted position before and after the target vehicle arrives at the location of the barrier strip so as to allow non-target vehicles to pass over the barrier strip before and after the target vehicle without receiving damage to their tires.

* * * * *